US012180961B2

(12) United States Patent
Kalidindi et al.

(10) Patent No.: US 12,180,961 B2
(45) Date of Patent: Dec. 31, 2024

(54) ASSEMBLIES FOR A HYDRAULIC GEAR PUMP WITH FORCE BALANCE AND INTERNAL COOLING FEATURES

(71) Applicant: Parker-Hannifin Corporation, Cleveland, OH (US)

(72) Inventors: Satish Kumar Raju Kalidindi, Mayfield Heights, OH (US); Hao Zhang, Twinsburg, OH (US); Yu-Sen Chu, Westlake, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 18/550,146

(22) PCT Filed: Jan. 14, 2022

(86) PCT No.: PCT/US2022/012415
§ 371 (c)(1),
(2) Date: Sep. 12, 2023

(87) PCT Pub. No.: WO2022/231670
PCT Pub. Date: Nov. 3, 2022

(65) Prior Publication Data

US 2024/0183354 A1 Jun. 6, 2024

Related U.S. Application Data

(60) Provisional application No. 63/182,072, filed on Apr. 30, 2021.

(51) Int. Cl.

| | |
|---|---|
| ***F04C 2/10*** | (2006.01) |
| ***F04C 15/00*** | (2006.01) |
| *F04C 23/00* | (2006.01) |

(52) U.S. Cl.
CPC ..... *F04C 2/102* (2013.01); *F04C 15/0096* (2013.01); *F04C 23/008* (2013.01); *F04C 2240/30* (2013.01); *F04C 2240/808* (2013.01)

(58) Field of Classification Search
CPC .. F04C 2/102; F04C 15/0042; F04C 15/0096; F04C 23/008; F04C 29/0007; F04C 2240/808
See application file for complete search history.

(56) References Cited

U.S. PATENT DOCUMENTS 3,034,448 A 5/1962 Brundage
5,501,585 A * 3/1996 Ogawa ..... F04C 2/102 418/71

(Continued)

FOREIGN PATENT DOCUMENTS

CN 211819898 U 10/2020
DE 28 43 447 A1 4/1980

(Continued)

OTHER PUBLICATIONS

JP 2014125955 A—Takahashi—Electric Pump—Jul. 7, 2014—English Machine Translation. (Year: 2014).*

(Continued)

*Primary Examiner* — Theresa Trieu
(74) *Attorney, Agent, or Firm* — McDonnell Boehnen Hulbert & Berghoff LLP

(57) ABSTRACT

An example gear pump includes a pump housing having a pump housing channel and an arcuate groove disposed in an interior surface of the pump housing; a pump ring gear disposed within the pump housing and rotatable relative to the pump housing; a pump pinion disposed within the pump ring gear, such that teeth of the pump pinion engage with internal teeth of the pump ring gear; and a pump port block having a first port and a second port, wherein as the pump pinion rotates within the pump ring gear, fluid is drawn (Continued)

through the first port and provided to the second port for discharge, wherein a portion of fluid being provided to the second port is provided to the pump housing channel, wherein fluid from the pump housing channel is provided to the arcuate groove to apply a radially-inward force on the pump ring gear.

12 Claims, 9 Drawing Sheets

(56) References Cited

U.S. PATENT DOCUMENTS

| | | | | |
|---|---|---|---|---|
| 9,863,419 | B2 | 1/2018 | Charwot et al. | |
| 2018/0254685 | A1 | 9/2018 | Seki | |
| 2020/0309130 | A1 | 10/2020 | Sakamoto et al. | |
| 2022/0128052 | A1* | 4/2022 | Zhang | F04C 15/0061 |

FOREIGN PATENT DOCUMENTS

| | | | |
|---|---|---|---|
| DE | 10 2015 112 664 | B4 | 9/2019 |
| EP | 1 674 728 | B1 | 2/2012 |
| JP | S60 17281 | A | 1/1985 |
| JP | H03 242482 | A | 10/1991 |
| JP | H07-145785 | A | 6/1996 |

OTHER PUBLICATIONS

International Search Report and Written Opinion issued by the European Patent Office in International Application No. PCT/US2022/012415 dated May 16, 2022.

Notice of Reasons of Refusal issued by the Japanese Patent Office in Application No. 2023-563994 dated Jul. 30, 2024. (English translation included).

* cited by examiner

ASSEMBLIES FOR A HYDRAULIC GEAR PUMP WITH FORCE BALANCE AND INTERNAL COOLING FEATURES

CROSS-REFERENCE TO RELATED APPLICATION

This application is a U.S. National Phase Application pursuant to 35 U.S.C § 371 of International Application No. PCT/US2022/012415 filed on Sep. 12, 2023, which claims priority to U.S. Provisional Application No. 63/182,072, filed Apr. 30, 2021, the entire contents of all of which are incorporated herein by reference.

BACKGROUND

A gear pump uses the meshing of gears to pump fluid by displacement. There are two main variations: external gear pumps, which use two external spur gears, and internal gear pumps, which use an external (e.g., pinion) and internal (e.g., ring) spur gears. Gear pumps have fixed displacement, where the pump can provide a constant amount of fluid for each revolution.

As the gears of the pump rotate, their teeth separate on the intake side of the pump, creating a void and suction, and the void is then filled by fluid. The fluid is carried by the gears to the discharge or outlet side of the pump, where the meshing of the gears displaces the fluid under pressure. In some cases, high pressure fluid at the outlet side of the pump may push the ring gear of an internal gear pump toward a housing of the pump, thereby increasing the likelihood of wear due to friction. It may thus be desirable to counter the force applied by the high pressure fluid on the gear to reduce wear.

Further, during operation of the pump, its housing may get heated. It may thus be desirable to cool the pump housing to alleviate any issues resulting from overheating the pump housing.

An electric motor can be used to drive the pump. For example, a rotor of the electric motor can be coupled to a shaft of the pump, such that rotation of the rotor can cause a rotating group of the pump to rotate and provide fluid flow.

An electronic drive device including an inverter and motor controller is typically separate from the motor and is connected to wire windings of a stator of the electric motor via cables. It may be desirable to have an assembly that integrates the pump and the electronic drive device with the electric motor. This way, mechanical components, such as shafts, bearing, etc., can be shared between hydraulic pump and the motor, and cables extending between a controller the motor can be eliminated.

It is with respect to these and other considerations that the disclosure made herein is presented.

SUMMARY

The present disclosure describes implementations that relate to assemblies for a hydraulic gear pump with force balance and internal cooling features.

In a first example implementation, the present disclosure describes a gear pump including: a pump housing having (i) a pump housing channel, and (ii) an arcuate groove disposed in an interior surface of the pump housing: a pump ring gear disposed within the pump housing and rotatable relative to the pump housing: a pump pinion disposed within the pump ring gear, such that external teeth of the pump pinion engage with internal teeth of the pump ring gear; and a pump port block having a first port and a second port, wherein as the pump pinion rotates within the pump ring gear, fluid is drawn from the first port and provided to the second port for discharge, wherein a portion of fluid being provided to the second port is provided to the pump housing channel to cool the pump housing, wherein fluid from the pump housing channel is provided to the arcuate groove, and wherein fluid in the arcuate groove applies a radially-inward force on the pump ring gear.

In a second example implementation, the present disclosure describes an assembly. The assembly includes: a main housing having an internal chamber therein; an electric motor disposed in the internal chamber of the main housing and comprising (i) a stator that is fixedly-positioned in the internal chamber of the main housing, and (ii) a rotor positioned within the stator and rotatable relative to the stator; and the gear pump of the first example implementation, wherein the gear pump is positioned in the main housing, at least partially within the rotor of the electric motor, and wherein the pump pinion is mounted to a pump drive shaft and that is rotatably-coupled to the rotor of the electric motor.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

The present disclosure relates to gear pump with force balance and internal cooling features. The disclosure also relates to integrating or embedding the gear pump and an electronic drive device (e.g., a motor controller as well as an inverter) with an electric motor to have an assembly providing a compact configuration that reduces cost by sharing components, saves space, and enhances reliability.

Figure 1:
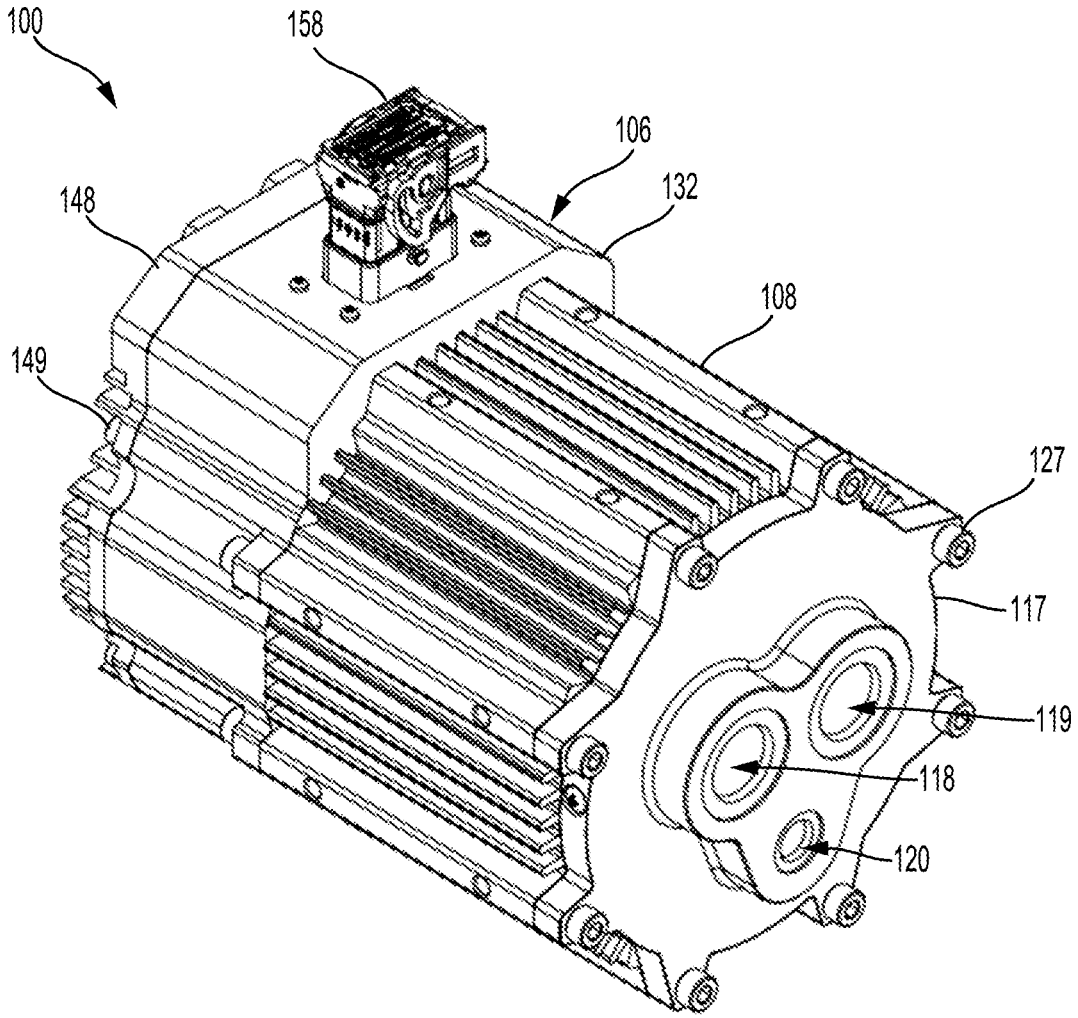
FIG. 1 illustrates a perspective view of an assembly, in accordance with an example implementation.
Figure 2:
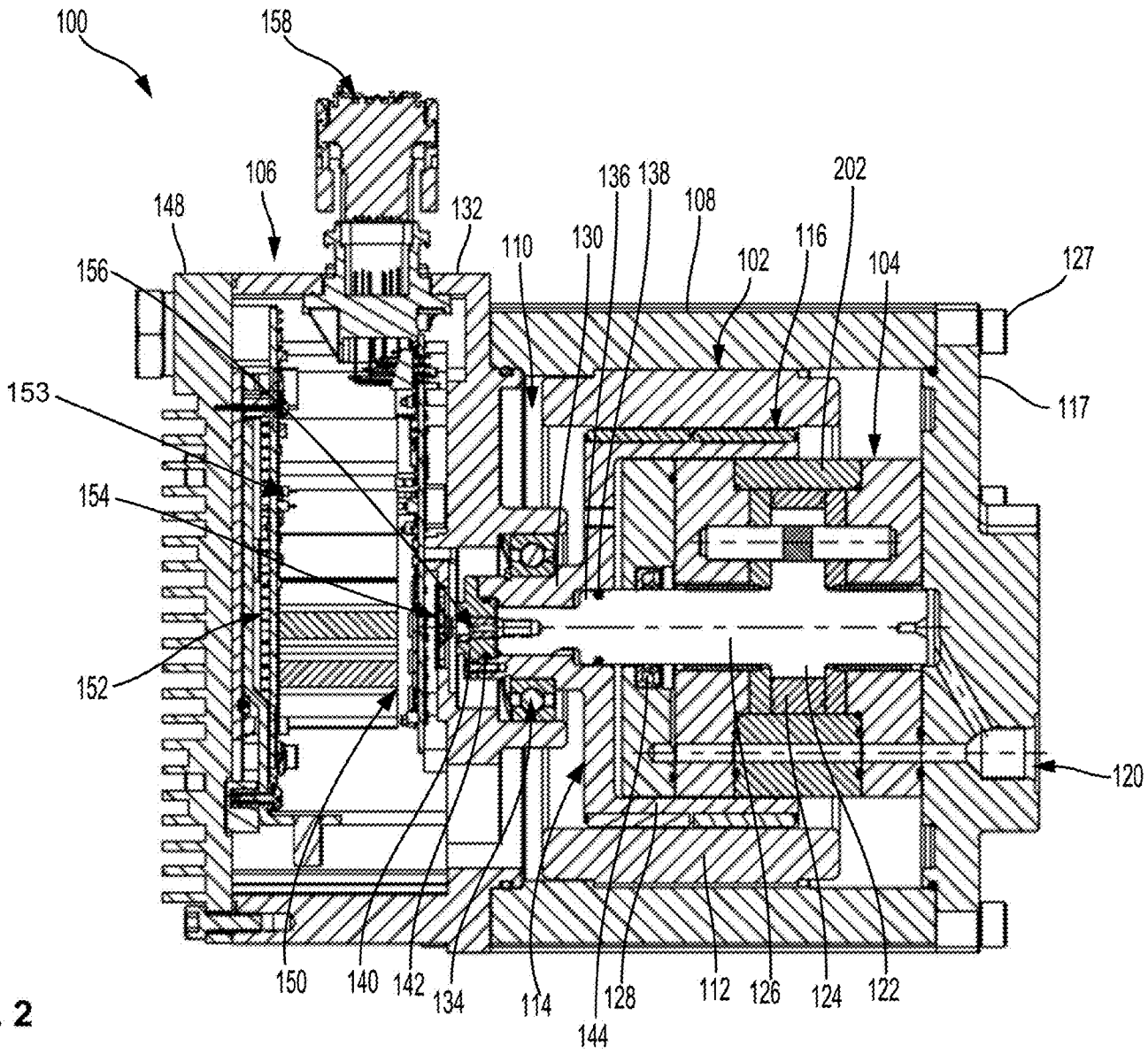
FIG. 2 illustrates a cross-sectional side view of the assembly of FIG. 1, in accordance with an example implementation.
Figure 3:
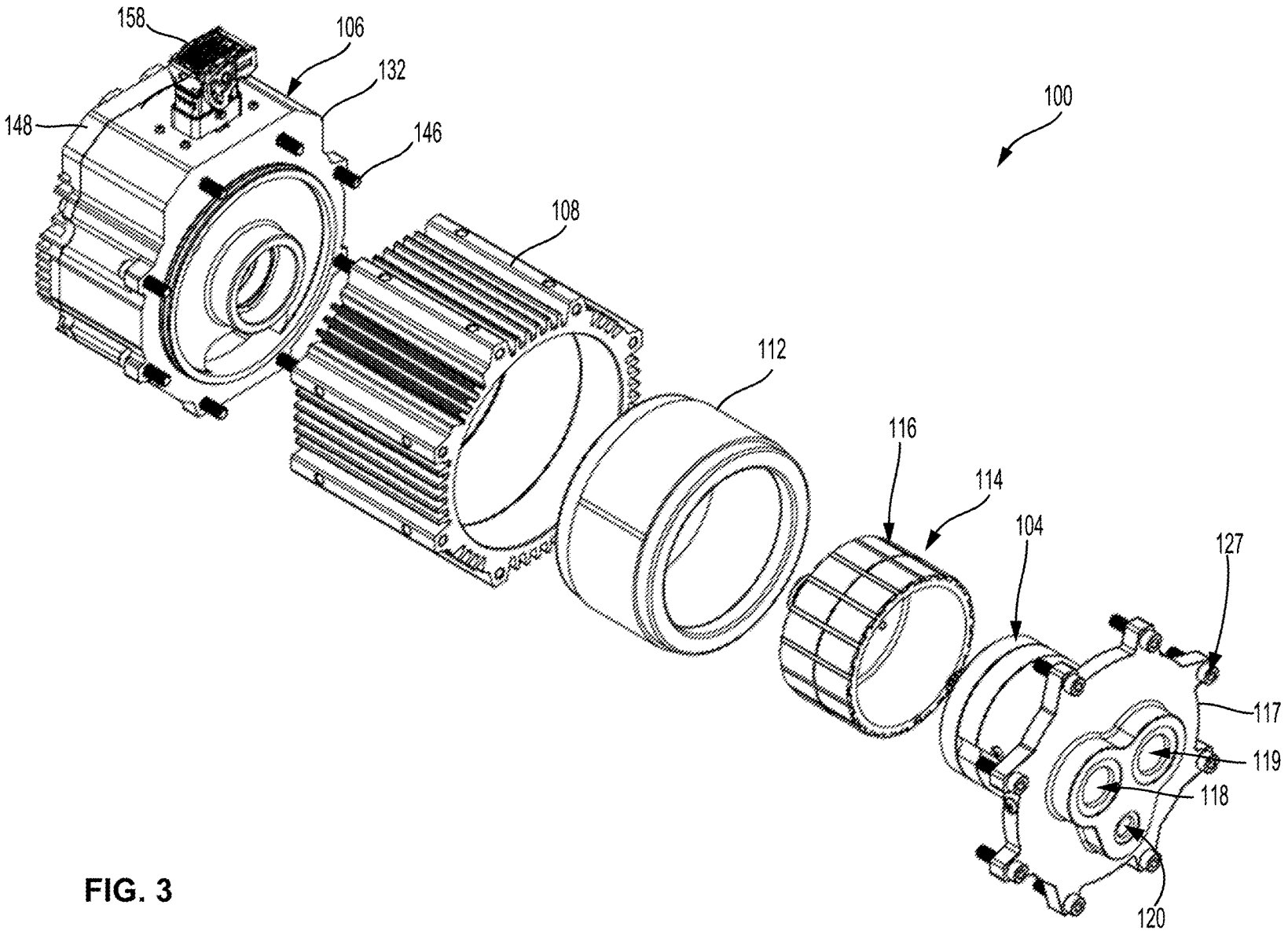
FIG. 3 illustrates a perspective exploded view of the assembly of FIG. 1, in accordance with another example implementation.

FIG. 1 illustrates a perspective view of an assembly 100, FIG. 2 illustrates a cross-sectional side view of the assembly 100, and FIG. 3 illustrates a perspective exploded view of the assembly 100, in accordance with an example implementation. FIGS. 1-3 are described together.

The assembly 100 comprises an electric motor 102, a gear pump 104, and an electronic drive device 106 integrated together. The assembly 100 includes a main housing 108 having an internal chamber 110 therein in which components of the electric motor 102 and the gear pump 104 are disposed.

The electric motor 102 includes a stator 112 fixedly-positioned within the internal chamber 110 of the main housing 108. The stator 112 is configured to generate a magnetic field. Particularly, the stator 112 can include wire windings (not shown) wrapped about a body (e.g., a lamination stack) of the stator 112, and when electric current is provided through the wire windings, a magnetic field is generated.

The electric motor 102 further includes a rotor 114 positioned within the stator 112. The electric motor 102 can further include magnets 116 mounted to the rotor 114 in an annular space between the stator 112 and the rotor 114. In an example, the magnets 116 include two circumferential arrays of magnets axially-spaced and disposed about the rotor 114 as shown in FIG. 3.

The magnets 116 are configured to interact with the magnetic field generated by the stator 112 in order to rotate the rotor 114 and produce torque. In other example implementation, a different type of electric motor might be used that does not include permanent magnets.

The gear pump 104 is mounted within the main housing 108 and, at least partially, within the rotor 114 and the stator 112 of the electric motor 102. The assembly 100 has a pump port block 117 having a first port 118, a second port 119, and a drain port 120.

The gear pump 104 is configured as an internal gear pump having a pump pinion 122 (e.g., a spur gear having external teeth formed in an exterior peripheral surface thereof) and a pump ring gear 124 (e.g., ring gear having internal teeth formed in an interior peripheral surface thereof) disposed within a pump housing 202. As depicted in FIG. 2, the pump pinion 122 is mounted to, or is an integral portion of, a pump drive shaft 126, and the teeth of the pump pinion 122 engage with the teeth of the pump ring gear 124. Further, the pump pinion 122 is mounted off-center relative to the pump ring gear 124, i.e., a center of rotation of the pump pinion 122 is eccentric relative to or offset from a center of rotation of the pump ring gear 124.

The pump port block 117 is coupled to the main housing 108 via a plurality of fasteners or bolts such as bolt 127.

The rotor 114 has a cylindrical portion 128 and a spindle portion 130. The spindle portion 130 is supported within an electronic device housing 132 of the electronic drive device 106 via a bearing 134 disposed about an exterior surface of the spindle portion 130 of the rotor 114 to allow the rotor 114 to rotate relative to the main housing 108 and the electronic device housing 132.

The pump drive shaft 126 is rotatably-coupled to the rotor 114 via spline engagement. Particularly, the pump drive shaft 126 has splines (e.g., splines 204 described below with respect to FIGS. 4-6) formed about the exterior surface of the pump drive shaft 126 and configured to engage with respective splines formed on an interior surface of the spindle portion 130 of the rotor 114. This way, the rotor 114 is drivingly connected to the pump drive shaft 126 and is configured to transmit rotary motion to the pump drive shaft 126 during operation.

As mentioned above, the rotor 114, and particularly the spindle portion 130 thereof, is supported about its exterior surface via the bearing 134. Additionally, the pump drive shaft 126 also supports the rotor 114 at an increased diameter portion 136 that provide support for the interior surface of the rotor 114 as shown in FIG. 2. As such, the rotor 114 is supported at two areas or points: an area about its exterior surfaces supported by the bearing 134 and an area about its interior surface where the rotor 114 is supported by the pump drive shaft 126. With this configuration, the pump drive shaft 126 provides an extended support for the rotor 114 and may preclude misalignments or twisting of the rotor 114 during operation.

During operation, as the rotor 114 rotates, the spline engagement with the pump drive shaft 126 causes the rotary motion of the rotor 114 to be transmitted to the pump drive shaft 126. It may be desirable to maintain the spline engagement lubricated. Such lubrication elongates the life of the components (e.g., the rotor 114 and the pump drive shaft 126) of the assembly 100. For example, grease may be used to lubricate the spline engagement.

It may be desirable to maintain the grease or any lubrication fluid at the area of spline engagement. As such, the assembly 100 includes a first seal 138 (e.g., an O-ring) disposed in a groove 139 (see FIGS. 5 and 7) formed about an exterior surface of the pump drive shaft 126. Further, the assembly 100 includes a cap 140 inserted within the spindle portion 130 of the rotor 114, and the cap 140 has a second seal 142 (e.g., an O-ring) disposed in a groove formed about a respective exterior surface of the cap 140.

The first seal 138 and the second seal 142 straddle the splines of the pump drive shaft 126 and the spindle portion 130. This way, any lubricant at the area of spline engagement is sealed and remains between the first seal 138 and the second seal 142. With this configuration, the lubricant might not leak outside the area of spline engagement. As shown in FIG. 2, the assembly 100 further includes a shaft seal 144 also disposed about the exterior surface of the pump drive shaft 126 and configured to preclude leakage of fluid from the gear pump 104 into the electric motor 102.

The electronic device housing 132 is coupled to the main housing via bolts such as bolt 146 shown in FIG. 3. The electronic device housing 132 is further coupled to an electronics housing cover 148 via a plurality of fasteners such as bolt 149 shown in FIG. 1. With this configuration, the electronic device housing 132 and the electronics housing cover 148 form an enclosure in which electronic boards and components of the electronic drive device 106 are disposed. This way, the electronic drive device 106 is integrated with the electric motor 102 and the gear pump 104 in the assembly 100.

As shown in FIG. 2, the electronic drive device 106 can include one or more electronic boards such as a controller board 150 and an inverter board 152 that are electrically-coupled and axially offset from each other as depicted. The controller board 150 and the inverter board 152 can be configured as printed circuit boards (PCBs). A PCB mechanically supports and electrically connects electronic components (e.g., microprocessors, integrated chips, capacitors, resistors, etc.) using conductive tracks, pads, and other features etched from one or more sheet layers of copper laminate onto and/or between sheet layers of a nonconductive substrate. Components are generally soldered onto the PCB to both electrically connect and mechanically fasten them to it.

The inverter board 152 can be separated from, and coupled to, the controller board 150 via stand-offs, for example. The inverter board 152 can include a plurality of bus bars that are electrically-conductive and are configured to receive direct current (DC) power and provide the power to components mounted to the inverter board 152.

As an example, the DC power can be provided to the inverter board 152 from a battery. With this configuration, DC power is provided to the bus bars, which then transmit the power to other components of the inverter board 152.

The inverter board 152 can be configured as a power converter that converts DC power received at the inverter board 152 to three-phase, alternating current (AC) power that can be provided to wire windings of the stator 112 to drive the electric motor 102. For example, the inverter board 152 can include a semiconductor switching matrix 153 mounted to the inverter board 152 and configured to be electrically-connected to a positive DC terminal and to a negative DC terminal. The inverter board 152 can further include a plurality of capacitors disposed in the axial space between the inverter board 152 and the controller board 150.

The semiconductor switching matrix 153 can include any arrangement of semiconductor switching devices that supports DC to three-phase power conversion. For example, the semiconductor switching matrix can include a three-phase, with bridge elements electrically-coupled to input DC terminals and connected to three-phase AC output terminals.

In an example, the semiconductor switching matrix 153 includes a plurality of transistors (e.g., an Insulated Gate Bipolar Transistor or a metal-oxide semiconductor field-effect transistor). The transistors are switchable between an activated or "on" state and a deactivated or "off" state, e.g., via a pulse width modulated (PWM) signal provided by a microprocessor mounted to the controller board 150. A microprocessor can comprise one or more processors. A processor can include a general purpose processor (e.g., an INTEL® single core microprocessor or an INTEL® multi-core microprocessor), or a special purpose processor (e.g., a digital signal processor, a graphics processor, or an application specific integrated circuit (ASIC) processor). A processor can be configured to execute computer-readable program instructions (CRPI) to perform the operations described throughout herein. A processor can be configured to execute hard-coded functionality in addition to or as an alternative to software-coded functionality (e.g., via CRPI).

As the transistors of the semiconductor switching matrix 153 are activated and deactivated at particular times via the PWM signal, AC voltage waveforms are generated at the AC output terminals. As such, the voltage waveforms at the AC output terminals are pulse width modulated and swing between voltage potential DC+ and voltage potential DC−. The AC voltage waveforms are then provided to the wire windings of the stator 112 to drive the electric motor 102. The controller board 150 and the inverter board 152 can include several junctions to facilitate receiving and transmitting signals and power therebetween and to other components of the assembly 100 or external components.

The electronic drive device 106 can include a plurality of sensors. For example, the electronic drive device 106 can include temperature sensors configured to provide information indicative of an operating temperature of the electric motor 102 and/or the fluid temperature of hydraulic fluid flowing through the gear pump 104. The electronic drive device 106 can also include Hall-Effect current sensors that provide information indicative of electric current level in windings of the stator 112.

The electronic drive device 106 can further include a pressure sensor indicative of pressure level of fluid within the assembly 100. The electronic drive device 106 can also include a rotary position sensor configured to provide sensor information indicative of the angular position of the rotor 114 and the pump drive shaft 126. The rotary position sensor information can be used by the microprocessor controlling the electric motor 102 so as to control speed and torque produced by the rotor 114 in a closed-loop feedback control configuration.

For example, the controller board 150 can include a sensor chip or encoder 154 to be mounted near the spindle portion 130 of the rotor 114 as show in FIG. 2. The encoder 154 can be configured to interact with a magnet 156 disposed in the cap 140. The encoder 154 is configured as an electro-mechanical device that converts the angular position or motion of the rotor 114 to analog or digital output signals that are provided to the microprocessor controlling the electric motor 102.

As shown in FIGS. 1-3, the electronic drive device 106 can further include an electric connector 158 configured as a hollow plastic component housing a plurality of conductor pins that are electrically-connected to the conductive tracks of the controller board 150. A connector socket (not shown) having female pins can be mounted to or inserted into the electric connector 158 such that the conductor pins contact the female pins of the connector socket. Wires can be connected to the female pins so as to provide signals to, and receive signals from, the conductor pins of the electric connector 158.

With this configuration, the electronic drive device 106 can receive via the electric connector 158 various inputs and sensor signals and provide commands in response to the received information. For example, the electronic drive device 106 can receive a command signal from a central controller or from an input device of a machine (e.g., a joystick of a hydraulic machine such as a wheel loader, backhoe, or excavator) indicative of a desired fluid pressure and fluid flow rate to be provided by the gear pump 104. The electronic drive device 106 can then control the AC power provided to the stator 112 to generate a particular speed and torque at the pump drive shaft 126 to achieve the desired fluid pressure level and flow rate. The electronic drive device 106 can also provide sensor signals (e.g., from the encoder 154) to another central controller via the electric connector 158.

As such, the electronic drive device 106 can be used as a controller for the assembly 100 as well as the actuator controlled by the assembly 100. Particularly, the electronic drive device 106 receives command inputs and sensor signals from sensors internal to the assembly 100 and sensors associated with the actuator, and responsively controls the electric motor 102 and the gear pump 104 to achieve desired or commanded motion of the actuator.

Although the gear pump 104 is described above as integrated into the assembly 100 including the electric motor 102 and the electronic drive device 106, the gear pump 104 can be used as a standalone pump. Details of the gear pump 104 are described next.

Figure 4:
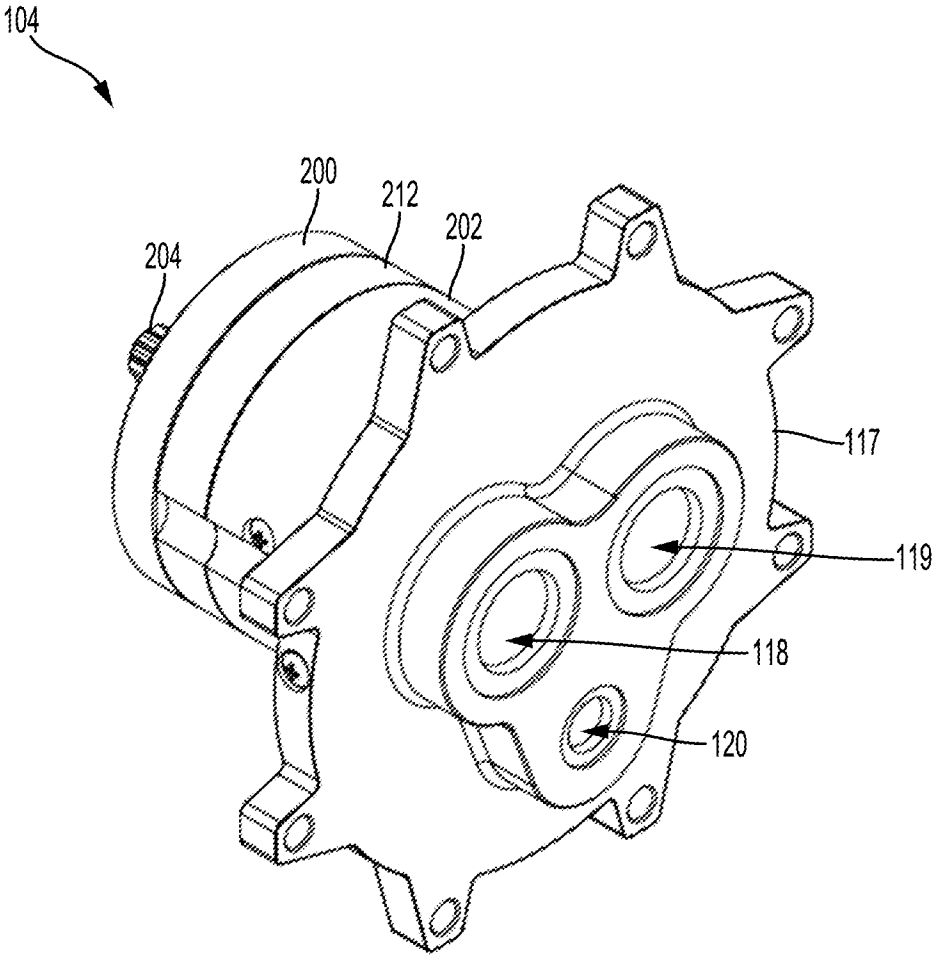
FIG. 4 illustrates a perspective view of a gear pump, in accordance with an example implementation.
Figure 5:
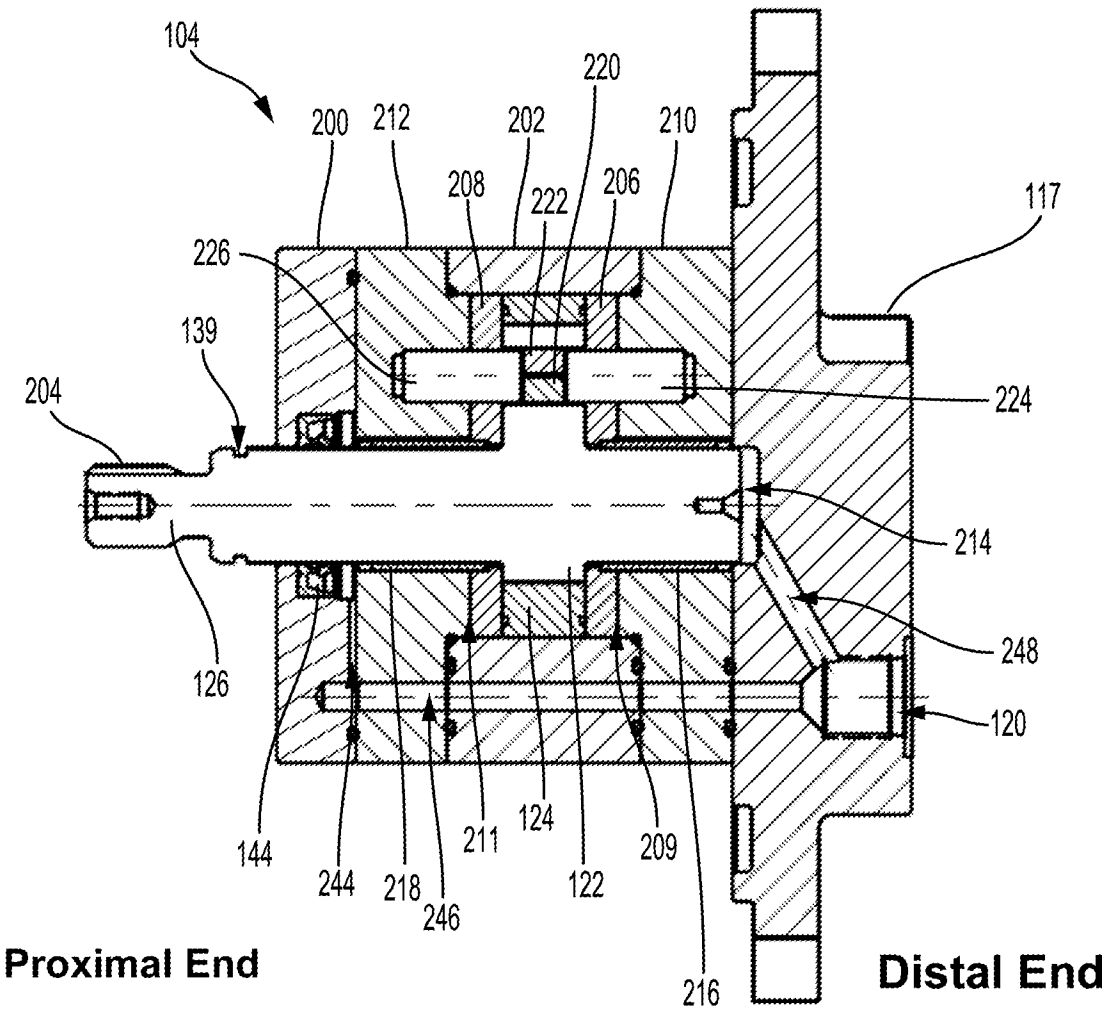
FIG. 5 illustrates a cross-sectional side view of the gear pump of FIG. 4, in accordance with an example implementation.
Figure 6:
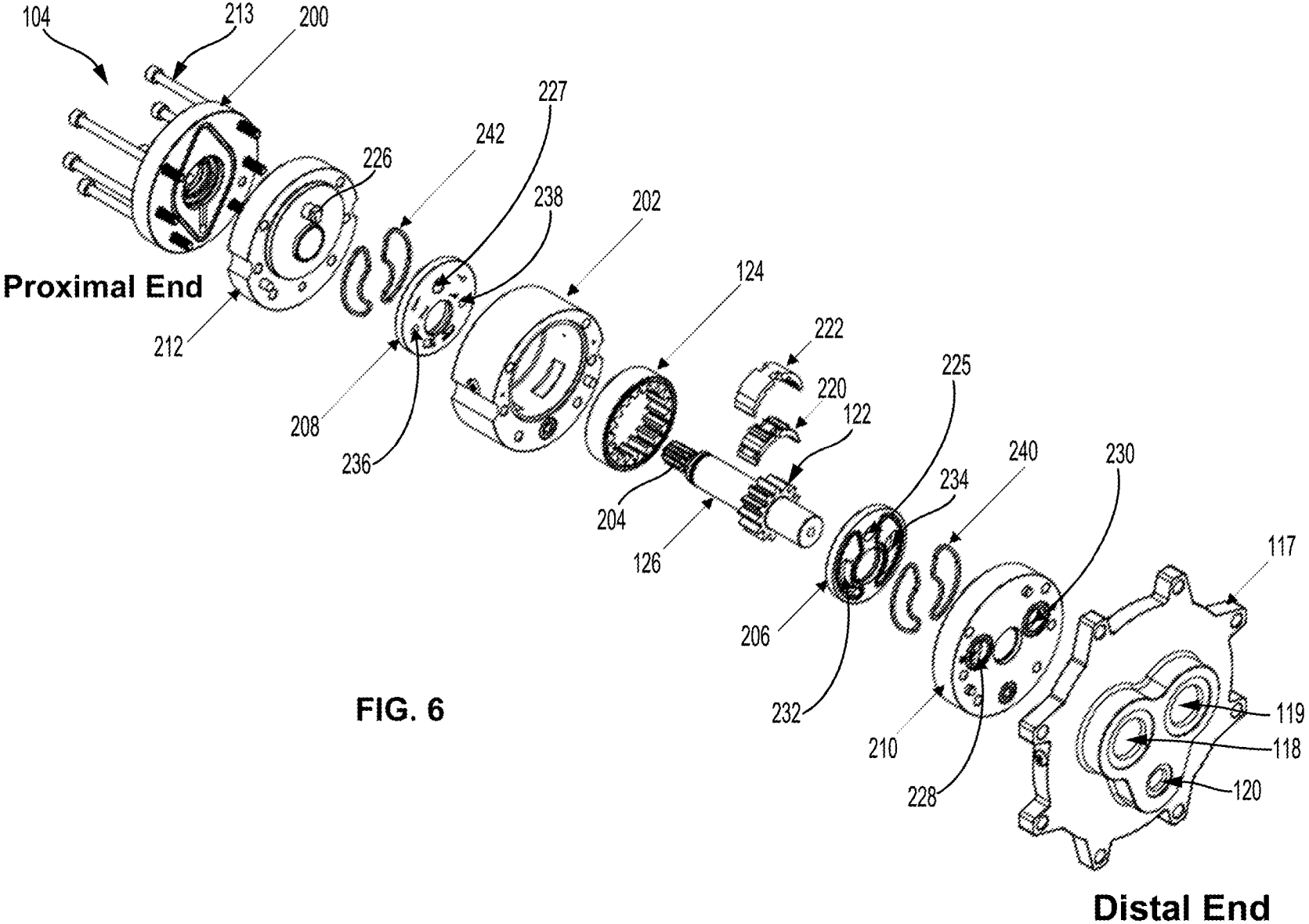
FIG. 6 illustrates a perspective exploded view of the gear pump of FIG. 4, in accordance with an example implementation.

FIG. 4 illustrates a perspective view of the gear pump 104, FIG. 5 illustrates a cross-sectional side view of the gear pump 104, and FIG. 6 illustrates a perspective exploded view of the gear pump 104, in accordance with an example implementation. FIGS. 4-6 are described together.

The gear pump 104 is mounted or interposed between the pump port block 117 and an end cover 200. As described above, the pump port block 117 includes the first port 118, the second port 119, and the drain port 120. The shaft seal 144 is disposed in a cavity formed in the end cover 200, such that the shaft seal 144 is disposed between an interior surface of the end cover 200 and the exterior surface of the pump drive shaft 126.

The gear pump 104 has a pump housing 202 configured to house components of the gear pump 104. The pump drive shaft 126 is rotatably coupled to the spindle portion 130 of the rotor 114 via the splines 204 to provide rotary motion to the pump pinion 122 and the pump ring gear 124 via the pump drive shaft 126.

The pump ring gear 124 and the pump pinion 122 are supported axially within the pump housing 202 via (i) a first thrust plate 206 disposed on distal sides of the pump ring gear 124 and the pump pinion 122, and (ii) a second thrust plate 208 on the proximal sides of the pump ring gear 124 and the pump pinion 122. As such, the pump pinion 122 and the pump ring gear 124 are interposed or sandwiched between the thrust plates 206, 208. As described below, the thrust plates 206, 208 can operate as axial compensator that can reduce the leakage within the gear pump 104 and improve its efficiency.

The thrust plates 206, 208 are in turn supported by a first pump cover 210 and a second pump cover 212. Particularly, the thrust plate 206 interfaces with the pump cover 210 at an interface 209, and the thrust plate 208 interfaces with the pump cover 212 at an interface 211. The term "interface" is used herein to indicate a point, plane, or space (or a portion of the plane or space) where two components meet and interact (e.g., where the thrust plates 206, 208 meet and interact with the pump covers 210, 212, respectively).

As illustrated by FIGS. 5-6, the first pump cover 210 interfaces with the pump port block 117. Similarly, the second pump cover 212 interfaces with the end cover 200. The pump covers 210, 212 have respective recesses or shoulders to support the pump housing 202 axially, such that the pump housing 202 is interposed between the pump covers 210, 212. The gear pump 104 can include several face seals at the interfaces between the different components to preclude leakage of fluid to an external environment of the gear pump 104.

The pump port block 117, the first pump cover 210, the second pump cover 212, and the end cover 200 have fastener through-holes disposed in a circular array, such that bolts 213 shown in FIG. 6 (e.g., socket head bolts) can be used to couple them axially together in a tight axial assembly. As such, the pump port block 117, the first pump cover 210, the second pump cover 212, and the end cover 200 and components of the gear pump 104 disposed therebetween can be aligned and stacked, then bolted together using the bolts 213.

With this configuration, components of the gear pump 104 are interposed between and supported by pump covers 210, 212, which in turn are supported by the pump port block 117 and the end cover 200. As depicted in FIG. 5, the end cover 200, the pump covers 210, 212, and the thrust plates 206, 208 include respective central through-holes to accommodate the pump drive shaft 126 therethrough. The pump port block 117 has a cavity 214 in which the distal end of the pump drive shaft 126 is disposed. Further, the gear pump 104 includes a bushing 216 and a bushing 218 disposed about the pump drive shaft 126 between its exterior surface and the interior surfaces of the pump covers 210, 212 and the thrust plates 206, 208 to allow rotation of the pump drive shaft 126. In an example, the bushings 216, 218 can be dry unlubricated (DU) bushings made of bronze and Teflon™ with steel reinforcement. The bushings 216, 218 are configured as bearings that facilitate rotation of the pump drive shaft 126.

The thrust plates 206, 208 are not bolted with the bolts 213, but are rather configured as floating components that can move axially as described below to make up for any axial clearances and reduce internal leakage within the gear pump 104.

The gear pump 104 is configured to operate as a bi-directional pump. Particularly, the first port 118 can operate as an inlet port configured to receive fluid from a fluid reservoir fluidly coupled to the assembly 100 (e.g., via a hose of any hydraulic line), and the second port 119 can operate as an outlet or discharge port for providing pressurized fluid being discharged from the gear pump 104 to a hydraulic actuator fluidly coupled to the assembly 100. The hydraulic actuator can, for example, be a hydraulic cylinder having a piston linearly moving therein or can be a hydraulic motor. In this mode of operation, the pump pinion 122 and the pump ring gear 124 rotate in a first rotational direction and the hydraulic actuator can move in a first direction.

In another mode of operation, the first port 118 can operate as a discharge port for providing pressurized fluid being discharged from the gear pump 104 to the hydraulic actuator, and the second port 119 can operate as an inlet port configured to receive fluid from the fluid reservoir. In this mode of operation, the pump pinion 122 and the pump ring gear 124 rotate in a second rotational direction opposite the first rotational direction, and the hydraulic actuator can move in a second direction opposite the first direction.

Operation of the gear pump 104 is described next assuming it rotates in a given direction. However, it should be understood that the gear pump 104 can operate in the other direction as well where the operation of the ports and fluid volumes is reversed.

During operation, as the pump drive shaft 126 rotates, the pump pinion 122 rotates within the pump ring gear 124. As the external gear teeth of the pump pinion 122 and the internal gear teeth of the pump ring gear 124 separate or disengage, they create an expanding volume (i.e., expanding chamber). The expanding volume collectively represents multiple pockets formed between the separating teeth. The expanding volume operates as a suction void forming between the separating teeth on the intake side of the gear pump 104 that is fluidly coupled to the inlet port (e.g., the first port 118). Fluid from the inlet port thus fills the expanding volume between the teeth.

The fluid is carried by the gear teeth of the pump pinion 122 and the pump ring gear 124 to another chamber or volume on a discharge side of the gear pump 104, which is fluidly coupled to the outlet port (e.g., the second port 119). The meshing of the gear teeth of the pump pinion 122 and the pump ring gear 124 displaces the fluid, and the fluid is then provided to the outlet port. As such, as the teeth of the pump pinion 122 and the pump ring gear 124 become interlocked on the discharge side of the gear pump 104, the volume is reduced and the fluid is forced out under pressure.

As the teeth of the pump pinion 122 and the pump ring gear 124 mesh, they form a seal between the expanding volume having low pressure fluid received from the inlet port and the volume between teeth that are meshing or are about to mesh at the discharge or outlet port. The seal created by the meshed teeth forces the fluid out of the discharge port and prevents fluid from flowing back toward the inlet port.

Further, as shown in FIGS. 5-6, the gear pump 104 includes a crescent seal assembly comprising an inner crescent 220 and an upper or outer crescent 222. The terms "inner" and "outer" indicate radial positioning of the crescents, where the inner crescent 220 is disposed radially inward relative to the outer crescent 222.

The inner crescent 220 and the outer crescent 222 are axially supported within the internal space between the pump ring gear 124 and the pump pinion 122 by a first locating pin 224 and a second locating pin 226 depicted in FIG. 5. Referring to FIGS. 5-6 together, the locating pin 224 is disposed partially in a blind hole or cavity formed in the first pump cover 210 and extends through a locating pin through-hole 225 in the thrust plate 206 to axially interface with distal ends of the crescents 220, 222. Similarly, the locating pin 226 is disposed partially in a blind hole or cavity formed in the second pump cover 212 and extends through a locating pin through-hole 227 in the thrust plate 208 to axially interface with proximal ends of the crescents 220, 222.

With this configuration, the inner crescent 220 and the outer crescent 222 are held axially in position by the locating pins 224, 226, and the locating pins 224, 226 also maintain the orientation of the crescents 220, 222. In other words, the locating pins 224, 226 support the crescent seal assembly (the inner crescent 220 and the outer crescent 222) axially.

As the pump pinion 122 and the pump ring gear 124 rotate during operation of the gear pump 104, the crescents 220, 222 divide the fluid as it is being carried from the low pressure suction expanding volume to the volume coupled to the discharge port. Thus, the crescents 220, 222 can form a seal between the low pressure volume and the high pressure volume.

Particularly, the outer surface (i.e., radially outward surface) of the outer crescent 222 interfaces with the inner teeth of the pump ring gear 124 to create a seal therebetween. An effective seal between the outer surface of the outer crescent 222 and the inner teeth of the pump ring gear 124 may preclude leakage from the high pressure volume to the low pressure volume. The terms "preclude" or "block" fluid flow is used herein to indicate substantially preventing fluid flow except for minimal flow of drops per minute, for example.

In a similar manner, the inner surface (i.e., radially inward surface) of the inner crescent 220 interfaces with the external teeth of the pump pinion 122 to create a seal therebetween. An effective seal between the inner surface of the inner crescent 220 and the external teeth of the pump pinion 122 may preclude leakage from the high pressure volume to the low pressure volume.

The configuration of a crescent seal assembly of the crescents 220, 222 provides for an effective seal and compensates for radial clearances between the crescents 220, 222 and the gear teeth to create an effective seal. Particularly, fluid from either the expanding volume or the high pressure volume seeping through the interface between the outer crescent 222 and the inner crescent 220 can push the crescents 220, 222 radially apart. The fluid between the crescents 220, 222 can thus push the outer crescent 222 radially outward toward the inner teeth of the pump ring gear 124, thereby eliminating any radial space or clearance therebetween and forming an effective seal. Similarly, the fluid between the crescents 220, 222 can push the inner crescent 220 radially inward toward the external teeth of the pump pinion 122, thereby eliminating any radial space or clearance therebetween and forming an effective seal.

Further, the crescents 220, 222 can be configured such that at least one spring cavity is formed therebetween. The spring cavities can be formed as recesses in the inner surface of the outer crescent 222. In other example implementations, the spring cavities can be formed as recesses in the outer surface of the inner crescent 220. In another example, both the inner crescent 220 and the outer crescent 222 can have mating or facing recesses that form the spring cavities therebetween.

The spring cavities can receive springs therein such as leaf springs. In addition to fluid pushing the crescents 220, 222 radially apart, the leaf springs disposed in the spring cavities can also push the crescents 220, 222 radially apart. With this configuration, the leaf springs can push the outer crescent 222 radially outward toward the inner teeth of the pump ring gear 124, thereby enhancing effectiveness of the seal therebetween. Similarly, the leaf springs can push the inner crescent 220 radially inward toward the external teeth of the pump pinion 122, thereby enhancing effectiveness of the seal therebetween. A leaf spring is used herein as an example biasing element. Other types of springs, such as wave springs or coil springs, can be used.

Further, the crescent seal assembly can include check valves between the crescents 220, 222 to preclude fluid flow from the high pressure volume to the low pressure volume regardless of the direction of rotation of the pump drive shaft 126. In particular, the outer crescent 222 and the inner crescent 220 can have recesses or grooves that form check valve cavities or recesses therebetween. Check pins can be positioned in such check valve cavities.

Pressurized fluid seeping between the crescents 220, 222 from a high pressure volume to a low pressure volume pushes the check pins against the surfaces of the crescents 220, 222, which form a seat for the check pin. The check pins thus create a seal with the surfaces of crescents and precludes leakage thereacross. Another oppositely disposed check pin and check valve cavity can preclude or block leakage in the other direction when the pump drive shaft 126 rotates in the other rotational direction.

This configuration of the crescent seal assembly thus enables the gear pump 104 to be bi-directional. Whether fluid is drawn through the first port 118 then displaced to the second port 119, or vice versa, the check pins operate as opposite check valves that block leakage fluid flow in either direction. Additional check pins can be added to further enhance the seal between the intake side and the discharge side of the gear pump 104.

As shown in FIG. 6, on the distal side of the pump pinion 122 and the pump ring gear 124, the first pump cover 210 can have through-hole 228 and through-hole 230 corresponding to and aligned with the first port 118 and the second port 119, respectively, to allow for fluid communication through the first pump cover 210. Similarly, the thrust plate 206 has a through-hole 232 and through-hole 234 that are generally kidney shaped and allow for fluid communication therethrough.

On the proximal side of the pump pinion 122 and the pump ring gear 124, the thrust plate 208 has multiple through-holes, such as through-hole 236, through-hole 238, among others, that allow for fluid communication therethrough. Fluid in the expanding volume and the high pressure volume formed between the pump pinion 122 and the pump ring gear 124 can thus be communicated axially in both directions via the through-holes in the thrust plates 206, 208. Fluid thus reaches the interfaces 209, 211 between the thrust plates 206, 208 and the pump covers 210, 212, respectively (see FIG. 5).

Fluid trapped at the interface 209 between the thrust plate 206 and the first pump cover 210 applies an axial fluid force on the thrust plate 206 toward distal end faces of the pump pinion 122 and the pump ring gear 124. This way, a metal-to-metal seal is created between the thrust plate 206 and the distal end faces of the pump pinion 122 and the pump ring gear 124. Similarly, fluid trapped at the interface 211 between the thrust plate 208 and the second pump cover 212 applies an axial fluid force on the thrust plate 208 toward proximal end faces of the pump pinion 122 and the pump ring gear 124. This way, a metal-to-metal seal is created between the thrust plate 208 and the proximal end faces of the pump pinion 122 and the pump ring gear 124.

The fluid forces acting on the thrust plates 206, 208 toward the pump pinion 122 and the pump ring gear 124 pushes or squeezes the thrust plates 206, 208 axially against the pump pinion 122 and the pump ring gear 124, thereby creating an effective seal and eliminating any axial gaps therebetween. As such, the thrust plates 206, 208 can be referred to as axial compensators as they can compensate for any axial gaps between the thrust plates 206, 208 and the pump pinion 122 and the pump ring gear 124 disposed therebetween, thereby reducing leakage and improving efficiency of the gear pump 104.

Referring to FIG. 6, the gear pump 104 can include a first set of seals such as first set of kidney-shaped seals 240 that can be disposed in contoured seal cavities or recesses in a distal side of the thrust plate 206, where the recesses have a shape matching the shape of the first set of kidney-shaped seals 240. With this configuration, the first set of kidney-shaped seals 240 isolate or seal high pressure fluid (from the high pressure volume) communicated to the interface 209 between the thrust plate 206 and the first pump cover 210 from low pressure fluid (from the expanding volume) communicated to the interface 209 between the thrust plate 206 and the pump cover 210. The first set of kidney-shaped seals 240 may thus preclude cross-flow or leakage from the high pressure side to the low pressure side.

Similarly, the gear pump 104 can include a second set of seals such as second set of kidney-shaped seals 242 disposed in contoured seal cavities or recesses in a proximal side of the thrust plate 208, where the recesses have a shape matching the shape of the second set of kidney-shaped seals 242. The second set of kidney-shaped seals 242 may isolate or seal high pressure fluid (from the high pressure volume) communicated to the interface 211 between the thrust plate 208 and the second pump cover 212 from low pressure fluid (from the expanding volume) communicated to the interface 211 between the thrust plate 208 and the second pump cover 212. The second set of kidney-shaped seals 242 may thus precludes cross-flow or leakage from the high pressure side to the low pressure side.

Referring back to FIG. 5, the second pump cover 212 can have channels (not shown) configured to communicate fluid at the interface 211 between the second pump cover 212 and the thrust plate 208 to a cavity or recess 244 in the end cover 200. The recess 244 in turn is fluidly coupled to the drain port 120 through a drain passage 246 to drain any high pressure fluid that reaches the end cover 200 to reduce internal pressure within the gear pump 104.

Similarly, the first pump cover 210 can have channels (not shown) that can communicate fluid to the cavity 214 in the pump port block 117. The cavity 214 in turn is fluidly coupled to the drain port 120 through a drain passage 248 to drain any high pressure fluid that reaches the pump port block 117 and reduce internal pressure within the gear pump 104.

As mentioned above, as external teeth of the pump pinion 122 separate from internal teeth of the pump ring gear 124 on the intake side of the gear pump 104, an expanding volume is created with low pressure. On the discharge side of the gear pump 104, as external teeth of the pump pinion 122 mesh with the internal teeth of the pump ring gear 124, a decreasing volume causes fluid to be forced out under pressure.

Such pressurized fluid between the pump pinion 122 and the pump ring gear 124 on the discharge side can apply a radially-outward force on the pump ring gear 124 toward the pump housing 202. As a result, friction and wear may occur at the interface between the pump ring gear 124 and the pump housing 202 at a region where the radially-outward force pushes the pump ring gear 124 toward the pump housing 202.

Such interface region may be different based on the direction of rotation of the pump pinion 122. Particularly, the region that tends to wear or is subjected to friction when the pump pinion 122 is rotating in a first direction (e.g., when the first port 118 is the inlet port and the second port 119 is the outlet port) may be different from a respective region that tends to wear or is subjected to friction when the pump pinion 122 is rotating in a second direction (e.g., when the second port 119 is the inlet port and the first port 118 is the outlet port).

Further, during operation, heat is generated and may cause damage to components of the gear pump 104. The gear pump 104 disclosed herein is configured to counter the friction forces resulting from high pressure fluid applying a radially-outward force on the pump ring gear 124 to alleviate such friction, and also configured to provide a cooling circuit to cool at least some of the components of the gear pump 104.

Figure 7:
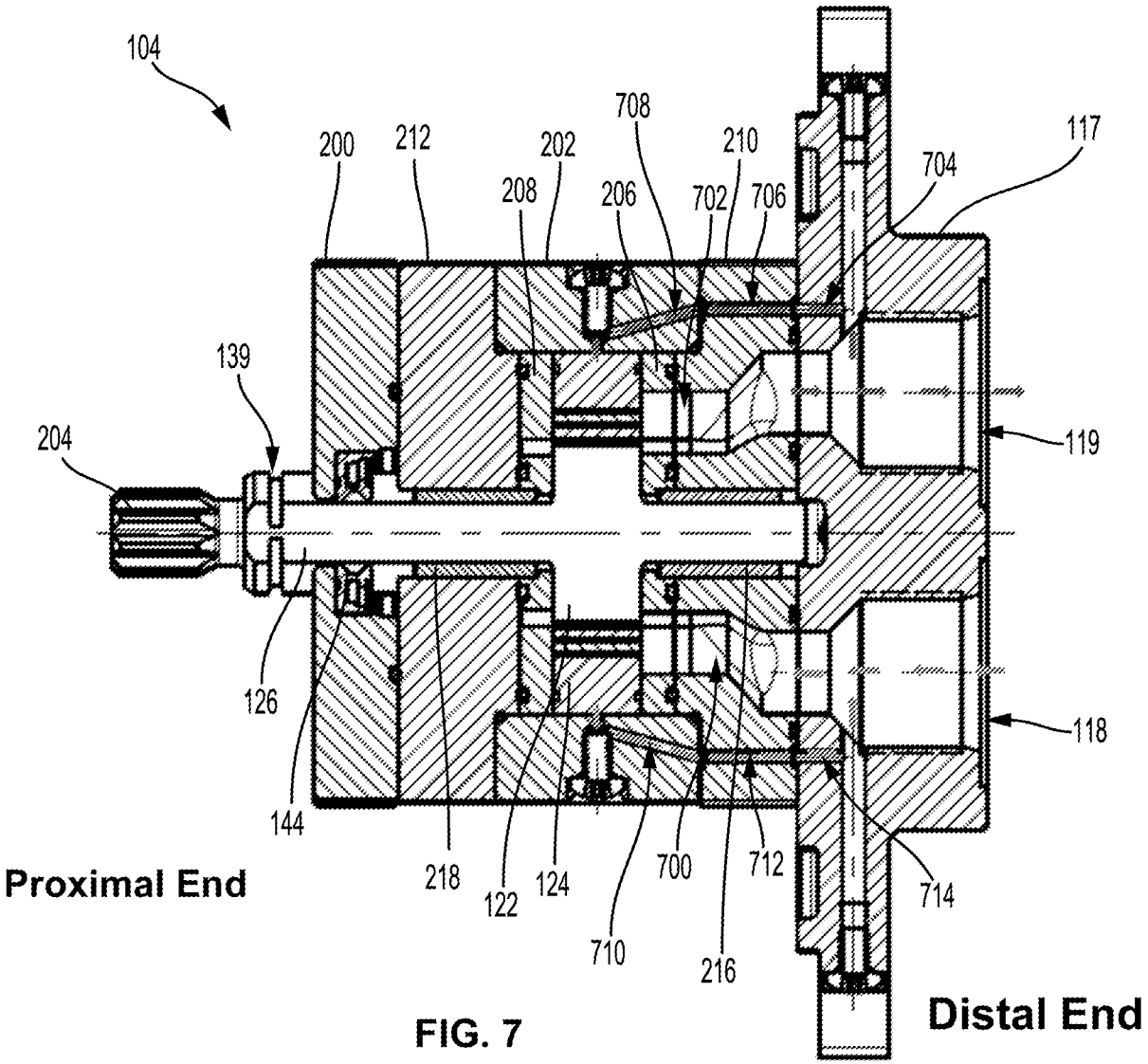
FIG. 7 illustrates a cross-sectional top view of the gear pump of FIG. 4 showing fluid paths within the assembly during operation, in accordance with an example implementation.

FIG. 7 illustrates a cross-sectional top view of the gear pump 104 showing fluid paths within the assembly during operation, in accordance with an example implementation. The cross-sectional top view of FIG. 7 is taken along a plane that is perpendicular to a respective plane of the cross-sectional side view of FIG. 5.

In FIG. 7, the first port 118 is the inlet port receiving fluid from a fluid reservoir, and the second port 119 is the outlet port where the gear pump 104 discharges pressurized fluid to a hydraulic actuator. Fluid received at the first port 118 flows through an inlet fluid passage 700 to the expanding chambers formed as the pump pinion 122 rotates within the pump ring gear 124. As the pump pinion 122 rotates within the pump ring gear 124, fluid is forced out under pressure to an outlet fluid passage 702, which then provides fluid to the second port 119.

Further, fluid being provided to the second port 119 is used to cool the pump housing 202. Particularly, a portion of fluid from the outlet fluid passage branches out or is diverted to flow through channel 704 formed in the pump port block 117, then through channel 706 formed in the pump cover 210 where the channel 706 is aligned with the channel 704, and then through a first pump housing channel 708 formed in the pump housing 202.

Figure 8B:
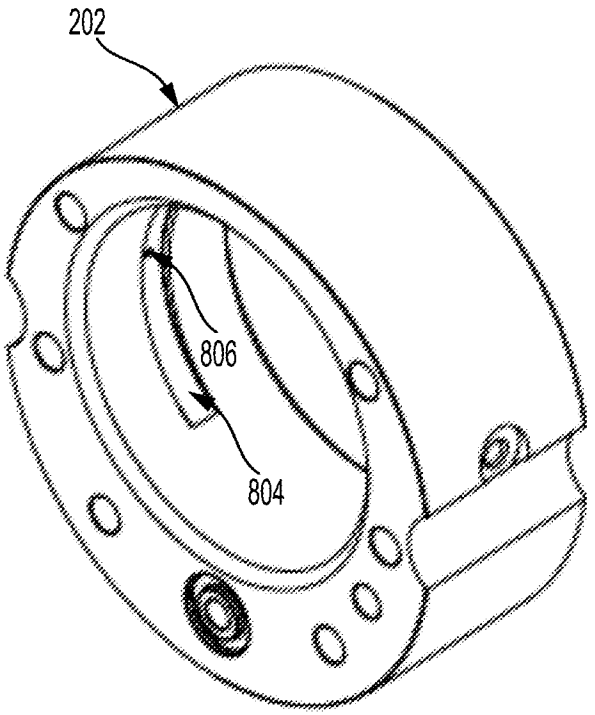
FIG. 8B illustrates another perspective view of the pump housing of FIG. 8A from a different angle, in accordance with an example implementation.
Figure 8A:
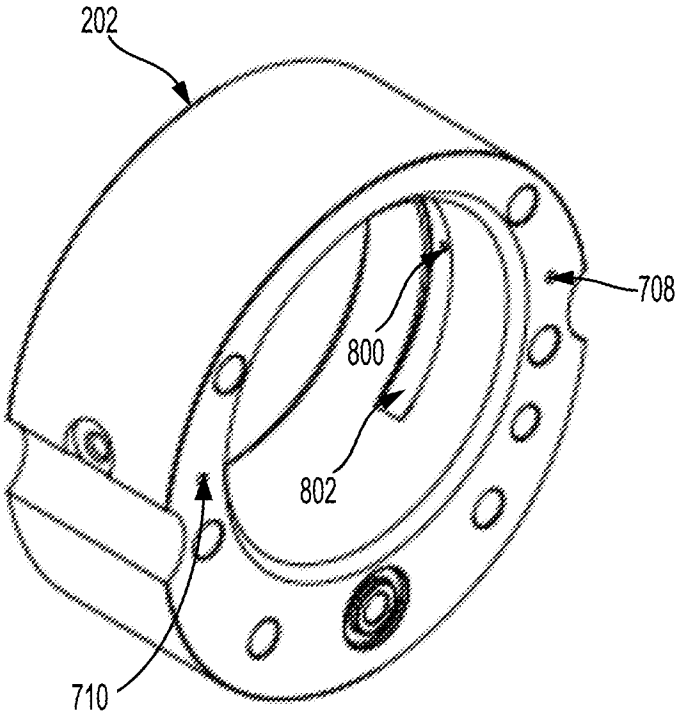
FIG. 8A illustrates a perspective view of a pump housing, in accordance with an example implementation.

FIG. 8A illustrates a perspective view of the pump housing 202, and FIG. 8B illustrates another perspective view of the pump housing 202 from a different angle, in accordance with an example implementation. Referring to FIGS. 7 and 8A together, the first pump housing channel 708 in the pump housing 202 is slanted, and provides fluid through an opening or a hole 800 in the pump housing to a first arcuate groove 802 formed in the interior surface of the pump housing 202.

As the pump ring gear 124 rotates, fluid received through the hole 800 can circulate in the clearance or annular space between the exterior surface of the pump ring gear 124 and the interior surface of the pump housing 202 and is provided to a second arcuate groove 804 shown in FIG. 8B. The pump housing 202 includes a hole 806 disposed in the second arcuate groove 804. As shown, the second arcuate groove 804 is angularly-spaced from the first arcuate groove 802 along an interior peripheral surface of the pump housing 202.

Referring to FIGS. 7 and 8B together, fluid in the second arcuate groove 804 is provided through the hole 806 to a second pump housing channel 710, then through channel 712 formed in the pump cover 210, and then through channel 714 formed in the pump port block 117, where the channel 714 is aligned with the channel 712. The fluid then joins fluid from the first port 118 to be provided to the expanding chambers formed between the teeth of the pump pinion 122 and the pump ring gear 124.

As such, fluid from outlet fluid passage 702 circulates through the pump housing 202 and may thus cool the pump housing 202 and reduce its temperature. Additionally, fluid provided to the first arcuate groove 802 may reduce wear and friction between the pump ring gear 124 and the pump housing 202.

As mentioned above, pressurized fluid between the pump pinion 122 and the pump ring gear 124 applies a radially-outward force on the pump ring gear 124 toward the pump housing 202. Pressurized fluid provided through the outlet fluid passage 702 and the first pump housing channel 708 can accumulate in the first arcuate groove 802, which operates as a pocket of fluid. Pressurized fluid in the first arcuate groove 802 applies a radially-inward force on the pump ring gear 124 that opposes or balances the radially-outward force acting on the pump ring gear 124. As a result, friction between the pump ring gear 124 and the pump housing 202 is reduced, and wear of the pump ring gear 124 and the pump housing 202 may be alleviated.

Notably, as mentioned above, the gear pump 104 is configured to be bi-directional and when the pump drive shaft 126 is driven in an opposite direction, where the second port 119 is the inlet port, the region subjected to wear may be different. In this case, a respective portion of pressurized fluid is provided to the second arcuate groove 804 rather than the first arcuate groove 802, and the pressurized fluid in the second arcuate groove 804 applies a respective radially-inward force that opposes the radially-outward force of fluid being squeezed by the teeth of the pump pinion 122 and the pump ring gear 124. In other words, the operations of the channels and the grooves of the gear pump 104 are reversed when the gear pump 104 reverses direction.

Although the holes 800, 806 are shown to be disposed within their respective arcuate groove, in other example implementation, the holes are not disposed within the grooves. In other words, the arcuate grooves could be circumferentially-spaced or angularly-spaced from the holes.

Figure 9B:
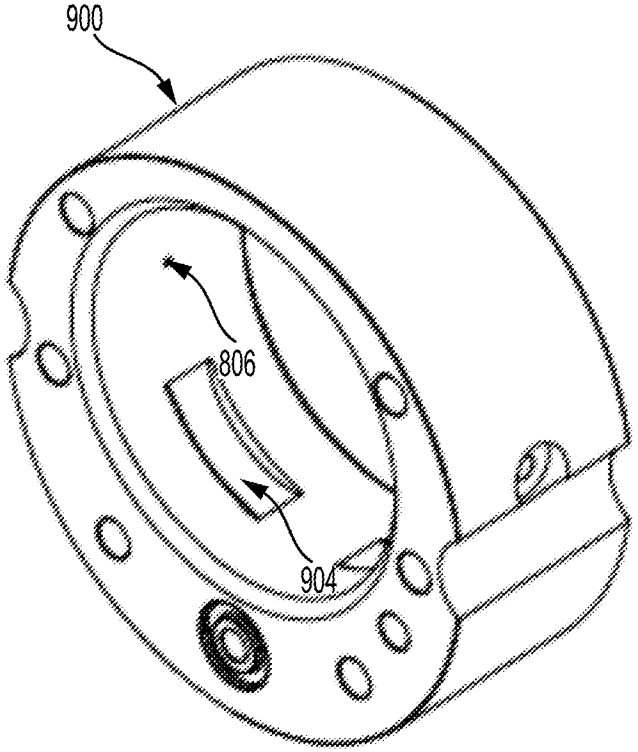
FIG. 9B illustrates another perspective view of the pump housing of FIG. 9A from a different angle, in accordance with an example implementation.
Figure 9A:
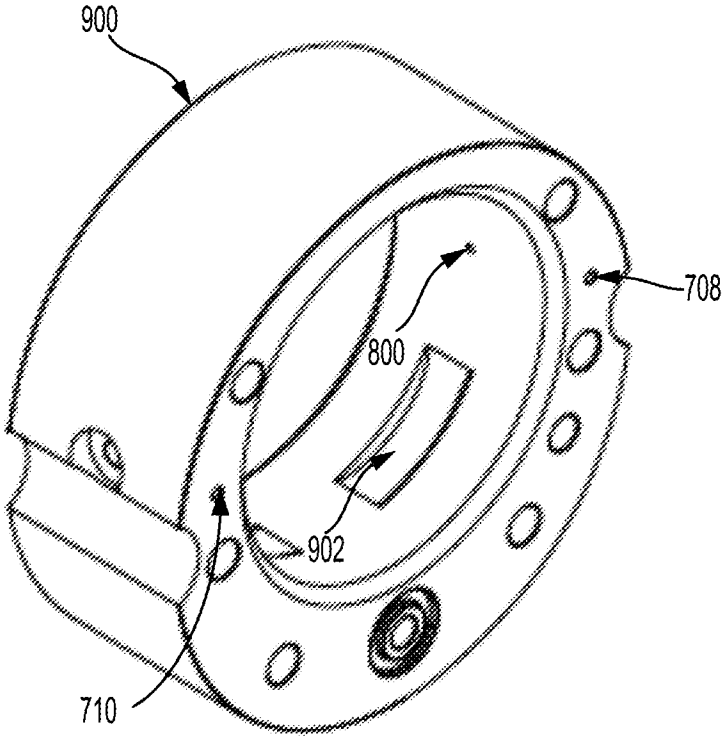
FIG. 9A illustrates a perspective view of a pump housing, in accordance with an example implementation.

FIG. 9A illustrates a perspective view of a pump housing 900, and FIG. 9B illustrates another perspective view of the pump housing 900 from a different angle, in accordance with an example implementation. The pump housing 900 has a first arcuate groove 902 and a second arcuate groove 904.

The pump housing 900 differs from the pump housing 202 in that the hole 800 is not disposed within the first arcuate groove 902, and the hole 806 is not disposed within the second arcuate groove 904. Rather, the first arcuate groove 902 is angularly-spaced from the hole 800, and the second arcuate groove 904 is angularly-spaced from the hole 806.

Fluid is provided through the hole 800 from the first pump housing channel 708 and is then dragged as the pump ring gear 124 rotates within the pump housing 900 to the first arcuate groove 902 where it accumulates when the gear pump 104 is operating in a first direction. When the gear pump 104 operates in the second direction, fluid provided through the hole 806 from second pump housing channel 710 and is then dragged as the pump ring gear 124 rotates within the pump housing 900 to the second arcuate groove 904 where it accumulates.

As such, the arcuate grooves (e.g., the arcuate grooves 902, 904) can be located at regions of the interior surface of the pump housing that are subjected to the most friction. This way, wear can be reduced and life of the pump housing and pump ring gear may be enhanced.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

Embodiments of the present disclosure can thus relate to one of the enumerated example embodiments (EEEs) listed below.

EEE 1 is a gear pump comprising: a pump housing having (i) a pump housing channel, and (ii) an arcuate groove disposed in an interior surface of the pump housing: a pump ring gear disposed within the pump housing and rotatable relative to the pump housing: a pump pinion disposed within the pump ring gear, such that external teeth of the pump pinion engage with internal teeth of the pump ring gear: and a pump port block having a first port and a second port, wherein as the pump pinion rotates within the pump ring gear, fluid is drawn from the first port and provided to the second port for discharge, wherein a portion of fluid being provided to the second port is provided to the pump housing channel to cool the pump housing, wherein fluid from the pump housing channel is provided to the arcuate groove, and wherein fluid in the arcuate groove applies a radially-inward force on the pump ring gear.

EEE 2 is the gear pump of EEE 1, wherein the pump housing further comprises a hole that is fluidly coupled to the pump housing channel, such that fluid flows from the pump housing channel through the hole to the arcuate groove.

EEE 3 is the gear pump of EEE 2, wherein the hole is disposed within the arcuate groove.

EEE 4 is the gear pump of any of EEEs 2-3, wherein the arcuate groove is angularly-spaced from the hole along the interior surface of the pump housing, and wherein as the pump pinion rotates, the pump ring gear rotates, thereby providing fluid received through the hole to the arcuate groove.

EEE 5 is the gear pump of any of EEEs 1-4, wherein as the pump pinion rotates, fluid between the external teeth of the pump pinion and internal teeth of the pump ring gear being provided to the second port applies a radially-outward force on the pump ring gear, and wherein the radially-inward force applied by fluid in the arcuate groove opposes the radially-outward force applied to the pump ring gear.

EEE 6 is the gear pump of any of EEEs 1-5, wherein the pump housing channel is a first pump housing channel, wherein the pump housing further comprises a second pump housing channel, and wherein as the pump ring gear rotates, fluid received through the first pump housing channel is provided to the second pump housing channel, and fluid in the second pump housing channel then joins fluid received through the first port.

EEE 7 is the gear pump of EEE 6, wherein the arcuate groove is a first arcuate groove, wherein the pump housing further comprises a second arcuate groove that is angularly-spaced from the first arcuate groove along the interior surface of the pump housing, and wherein: as the pump pinion rotates in an opposite direction within the pump ring gear, fluid is drawn from the second port and provided to the first port for discharge, wherein a respective portion of fluid being provided to the first port is diverted to the second pump housing channel to cool the pump housing, wherein fluid from the second pump housing channel is provided to the second arcuate groove, and wherein fluid in the second arcuate groove applies a respective radially-inward force on the pump ring gear.

EEE 8 is the gear pump of any of EEEs 1-7, further comprising: a pump cover interposed between the pump port block and the pump housing, wherein the pump cover comprises a channel that is aligned with the pump housing channel, and wherein the portion of fluid diverted to the pump housing channel flows through the channel of the pump cover to the pump housing channel.

EEE 9 is the gear pump of EEE 8, further comprising: a thrust plate interposed between the pump cover and the pump ring gear; and a seal disposed within a seal cavity formed at an interface between the thrust plate and the pump cover.

EEE 10 is the gear pump of EEE 9, further comprising: a crescent seal assembly comprising an outer crescent and an inner crescent disposed within the pump ring gear between the pump pinion and the pump ring gear; and a locating pin disposed in a cavity formed in the pump cover, such that the locating pin protrudes axially from the pump cover, wherein the thrust plate includes a locating pin through-hole, and wherein the locating pin extends through the locating pin through-hole and protrudes from thrust plate to interface with the crescent seal assembly, thereby supporting the crescent seal assembly axially.

EEE 11 is an assembly comprising: a main housing having an internal chamber therein: an electric motor disposed in the internal chamber of the main housing and comprising (i) a stator that is fixedly-positioned in the internal chamber of the main housing, and (ii) a rotor positioned within the stator and rotatable relative to the stator; and a gear pump positioned in the main housing, at least partially within the rotor of the electric motor, wherein the gear pump comprises: a pump housing having (i) a pump housing channel, and (ii) an arcuate groove disposed in an interior surface of the pump housing, a pump ring gear disposed within the pump housing and rotatable relative to the pump housing, a pump pinion disposed within the pump ring gear, such that external teeth of the pump pinion engage with internal teeth of the pump ring gear, wherein the pump pinion is mounted to a pump drive shaft and that is rotatably-coupled to the rotor of the electric motor, and a pump port block having a first port and a second port, wherein as the rotor of the electric motor rotates the pump pinion within the pump ring gear, fluid is drawn from the first port and provided to the second port for discharge, wherein a portion of fluid being provided to the second port is provided to the pump housing channel to cool the pump housing, wherein fluid from the pump housing channel is provided to the arcuate groove, and wherein fluid in the arcuate groove applies a radially-inward force on the pump ring gear.

EEE 12 is the assembly of EEE 11, wherein the rotor comprises (i) a cylindrical portion in which the gear pump is at least partially disposed, and (ii) a spindle portion, wherein the pump drive shaft is rotatably-coupled to the spindle portion of the rotor.

EEE 13 is the assembly of EEE 12, wherein the pump drive shaft is rotatably-coupled to the spindle portion of the rotor via a spline engagement, wherein the assembly comprises a first seal and a second seal, wherein the spline engagement is interposed between the first seal and the second seal, such that a lubricant is sealed at the spline engagement between the first seal and the second seal.

EEE 14 is the assembly of EEE 13, further comprising: a cap disposed at an end of the spindle portion of the rotor, wherein the first seal is disposed in a first groove about an exterior surface of the pump drive shaft, and wherein the second seal is disposed in a second groove about a respective exterior surface of the cap.

EEE 15 is the assembly of any of EEEs 11-14, further comprising: an electronic device housing coupled to the main housing: an electronics housing cover coupled to the electronic device housing, such that an enclosure is formed by the electronics housing cover and the electronic device housing: and one or more electronic boards disposed in the enclosure.

EEE 16 is the assembly of EEE 15, wherein the one or more electronic boards comprise: an inverter board having a semiconductor switching matrix mounted thereon, wherein the semiconductor switching matrix comprises a plurality of semiconductor switching devices configured to convert direct current power to three-phase alternating current power to drive the electric motor: and a controller board axially offset from the inverter board and electrically-coupled to the inverter board, wherein the controller board comprises a processor configured to generate switching signal to operate the semiconductor switching matrix.

EEE 17 is the assembly of EEE 16, wherein the controller board further comprises an encoder mounted thereto and configured to interact with a magnet coupled to the rotor to provide sensor information to the processor indicative of a rotary position of the rotor.

EEE 18 is the assembly of any of EEEs 11-17, wherein as the pump pinion rotates, fluid between the external teeth of the pump pinion and internal teeth of the pump ring gear being provided to the second port applies a radially-outward force on the pump ring gear, and wherein the radially-inward force applied by fluid in the arcuate groove opposes the radially-outward force applied to the pump ring gear.

EEE 19 is the assembly of any of EEEs 11-18, wherein the pump housing channel is a first pump housing channel, wherein the pump housing further comprises a second pump housing channel, and wherein as the pump ring gear rotates, fluid received through the first pump housing channel is provided to the second pump housing channel, and fluid in the second pump housing channel then joins fluid received through the first port.

EEE 20 is the assembly of EEE 19, wherein the arcuate groove is a first arcuate groove, wherein the pump housing further comprises a second arcuate groove that is angularly-spaced from the first arcuate groove along the interior surface of the pump housing, and wherein: as the rotor rotates the pump pinion in an opposite direction within the pump ring gear, fluid is drawn from the second port and provided to the first port for discharge, wherein a respective portion of fluid being provided to the first port is diverted to the second pump housing channel to cool the pump housing, wherein fluid from the second pump housing channel is provided to the second arcuate groove, and wherein fluid in the second arcuate groove applies a respective radially-inward force on the pump ring gear.

What is claimed is:

1. A gear pump comprising:

a pump housing having (i) a pump housing channel, (ii) an arcuate groove disposed in an interior surface of the pump housing, and (iii) a hole that is fluidly coupled to the pump housing channel, wherein the arcuate groove is angularly-spaced from the hole along the interior surface of the pump housing;

a pump ring gear disposed within the pump housing and rotatable relative to the pump housing;

a pump pinion disposed within the pump ring gear, such that external teeth of the pump pinion engage with internal teeth of the pump ring gear; and a pump port block having a first port and a second port, wherein as the pump pinion rotates within the pump ring gear, fluid is drawn through the first port and provided to the second port for discharge, wherein a portion of fluid being provided to the second port is provided to the pump housing channel to cool the pump housing, wherein as the pump pinion rotates, the pump ring gear rotates, thereby providing fluid received from the pump housing channel through the hole to the arcuate groove, and wherein fluid in the arcuate groove applies a radially-inward force on the pump ring gear.

2. The gear pump of claim 1, wherein as the pump pinion rotates, fluid between the external teeth of the pump pinion and internal teeth of the pump ring gear being provided to the second port applies a radially-outward force on the pump ring gear, and wherein the radially-inward force applied by fluid in the arcuate groove opposes the radially-outward force applied to the pump ring gear.

3. A gear pump comprising:

a pump housing having (i) a first pump housing channel, (ii) a second pump housing channel, (iii) a first arcuate groove disposed in an interior surface of the pump housing, and (iv) a second arcuate groove that is angularly-spaced from the first arcuate groove along the interior surface of the pump housing:

a pump ring gear disposed within the pump housing and rotatable relative to the pump housing;

a pump pinion disposed within the pump ring gear, such that external teeth of the pump pinion engage with internal teeth of the pump ring gear; and a pump port block having a first port and a second port, wherein as the pump pinion rotates within the pump ring gear, fluid is drawn through the first port and provided to the second port for discharge, wherein a portion of fluid being provided to the second port is provided to the first pump housing channel to cool the pump housing, wherein fluid from the first pump housing channel is provided to the first arcuate groove, and wherein fluid in the first arcuate groove applies a radially-inward force on the pump ring gear, and wherein:

as the pump pinion rotates in an opposite direction within the pump ring gear, fluid is drawn from the second port and provided to the first port for discharge, wherein a respective portion of fluid being provided to the first port is diverted to the second pump housing channel to cool the pump housing, wherein fluid from the second pump housing channel is provided to the second arcuate groove, and wherein fluid in the second arcuate groove applies a respective radially-inward force on the pump ring gear.

4. A gear pump comprising:

a pump housing having (i) a pump housing channel, and (ii) an arcuate groove disposed in an interior surface of the pump housing;

a pump ring gear disposed within the pump housing and rotatable relative to the pump housing;

a pump pinion disposed within the pump ring gear, such that external teeth of the pump pinion engage with internal teeth of the pump ring gear;

a pump port block having a first port and a second port, wherein as the pump pinion rotates within the pump ring gear, fluid is drawn through the first port and provided to the second port for discharge, wherein a portion of fluid being provided to the second port is provided to the pump housing channel to cool the pump housing, wherein fluid from the pump housing channel is provided to the arcuate groove, and wherein fluid in the arcuate groove applies a radially-inward force on the pump ring gear;

a pump cover interposed between the pump port block and the pump housing, wherein the pump cover comprises a channel that is aligned with the pump housing channel, and wherein the portion of fluid diverted to the pump housing channel flows through the channel of the pump cover to the pump housing channel;

a thrust plate interposed between the pump cover and the pump ring gear; and a seal disposed within a seal cavity formed at an interface between the thrust plate and the pump cover.

5. The gear pump of claim 4, further comprising:

a crescent seal assembly comprising an outer crescent and an inner crescent disposed within the pump ring gear between the pump pinion and the pump ring gear; and a locating pin disposed in a cavity formed in the pump cover, such that the locating pin protrudes axially from the pump cover, wherein the thrust plate includes a locating pin through-hole, and wherein the locating pin extends through the locating pin through-hole and protrudes from thrust plate to interface with the crescent seal assembly, thereby supporting the crescent seal assembly axially.

6. An assembly comprising:

a main housing having an internal chamber therein;

an electric motor disposed in the internal chamber of the main housing and comprising (i) a stator that is fixedly-positioned in the internal chamber of the main housing, and (ii) a rotor positioned within the stator and rotatable relative to the stator, wherein the rotor comprises: (a) a cylindrical portion, and (b) a spindle portion; and a gear pump positioned in the main housing, at least partially within the cylindrical portion of the rotor of the electric motor, wherein the gear pump comprises:

a pump housing having (i) a pump housing channel, and (ii) an arcuate groove disposed in an interior surface of the pump housing, a pump ring gear disposed within the pump housing and rotatable relative to the pump housing, a pump pinion disposed within the pump ring gear, such that external teeth of the pump pinion engage with internal teeth of the pump ring gear, wherein the pump pinion is mounted to a pump drive shaft that is rotatably-coupled to the spindle portion of the rotor of the electric motor via a spline engagement, a first seal and a second seal, wherein the spline engagement is interposed between the first seal and the second seal, such that a lubricant is sealed at the spline engagement between the first seal and the second seal, and a pump port block having a first port and a second port, wherein as the rotor of the electric motor rotates the pump pinion within the pump ring gear, fluid is drawn through the first port and provided to the second port for discharge, wherein a portion of fluid being provided to the second port is provided to the pump housing channel to cool the pump housing, wherein fluid from the pump housing channel is provided to the arcuate groove, and wherein fluid in the arcuate groove applies a radially-inward force on the pump ring gear.

7. The assembly of claim 6, further comprising:

a cap disposed at an end of the spindle portion of the rotor, wherein the first seal is disposed in a first groove about an exterior surface of the pump drive shaft, and wherein the second seal is disposed in a second groove about a respective exterior surface of the cap.

8. The assembly of claim 6, wherein as the pump pinion rotates, fluid between the external teeth of the pump pinion and internal teeth of the pump ring gear being provided to the second port applies a radially-outward force on the pump ring gear, and wherein the radially-inward force applied by fluid in the arcuate groove opposes the radially-outward force applied to the pump ring gear.

9. The assembly of claim 6, wherein the pump housing channel is a first pump housing channel, wherein the pump housing further comprises a second pump housing channel, and wherein as the pump ring gear rotates, fluid received through the first pump housing channel is provided to the second pump housing channel, and fluid in the second pump housing channel then joins fluid received through the first port.

10. The assembly of claim 9, wherein the arcuate groove is a first arcuate groove, wherein the pump housing further comprises a second arcuate groove that is angularly-spaced from the first arcuate groove along the interior surface of the pump housing, and wherein:

as the rotor rotates the pump pinion in an opposite direction within the pump ring gear, fluid is drawn from the second port and provided to the first port for discharge, wherein a respective portion of fluid being provided to the first port is diverted to the second pump housing channel to cool the pump housing, wherein fluid from the second pump housing channel is provided to the second arcuate groove, and wherein fluid in the second arcuate groove applies a respective radially-inward force on the pump ring gear.

11. An assembly comprising:

a main housing having an internal chamber therein;

an electric motor disposed in the internal chamber of the main housing and comprising (i) a stator that is fixedly-positioned in the internal chamber of the main housing, and (ii) a rotor positioned within the stator and rotatable relative to the stator;

an electronic device housing coupled to the main housing;

an electronics housing cover coupled to the electronic device housing, such that an enclosure is formed by the electronics housing cover and the electronic device housing; and one or more electronic boards disposed in the enclosure;

an inverter board having a semiconductor switching matrix mounted thereon, wherein the semiconductor switching matrix comprises a plurality of semiconductor switching devices configured to convert direct current power to three-phase alternating current power to drive the electric motor;

a controller board axially offset from the inverter board and electrically-coupled to the inverter board, wherein the controller board comprises a processor configured to generate switching signal to operate the semiconductor switching matrix; and a gear pump positioned in the main housing, at least partially within the rotor of the electric motor, wherein the gear pump comprises:

a pump housing having (i) a pump housing channel, and (ii) an arcuate groove disposed in an interior surface of the pump housing, a pump ring gear disposed within the pump housing and rotatable relative to the pump housing, a pump pinion disposed within the pump ring gear, such that external teeth of the pump pinion engage with internal teeth of the pump ring gear, wherein the pump pinion is mounted to a pump drive shaft and that is rotatably-coupled to the rotor of the electric motor, and a pump port block having a first port and a second port, wherein as the rotor of the electric motor rotates the pump pinion within the pump ring gear, fluid is drawn through the first port and provided to the second port for discharge, wherein a portion of fluid being provided to the second port is provided to the pump housing channel to cool the pump housing, wherein fluid from the pump housing channel is provided to the arcuate groove, and wherein fluid in the arcuate groove applies a radially-inward force on the pump ring gear.

12. The assembly of claim 11, wherein the controller board further comprises an encoder mounted thereto and configured to interact with a magnet coupled to the rotor to provide sensor information to the processor indicative of a rotary position of the rotor.

* * * * *